US005709372A

United States Patent [19]

Lii

[11] Patent Number: 5,709,372

[45] Date of Patent: Jan. 20, 1998

[54] C CLAMP

[76] Inventor: Liang-Kuen Lii, 58, Ma Yuan West St., Taichung, Taiwan

[21] Appl. No.: 562,930

[22] Filed: Nov. 27, 1995

Related U.S. Application Data

[62] Division of Ser. No. 501,424, Jul. 3, 1995, abandoned.

[51] Int. Cl.[6] ..... B66F 3/00

[52] U.S. Cl. ..... 269/6

[58] Field of Search ..... 269/3, 6, 249, 269/143, 166–170; 222/325–327, 391; 81/487

[56] References Cited

U.S. PATENT DOCUMENTS

| | | | |
|---|---|---|---|
| 3,218,058 | 11/1965 | Smith | 269/166 |
| 4,874,155 | 10/1989 | Goul | 269/6 |
| 5,217,213 | 6/1993 | Lii | 269/6 |
| 5,222,420 | 6/1993 | Sorensen et al. | 269/169 |

*Primary Examiner*—Robert C. Watson

[57] ABSTRACT

A C-clamp has a generally C-shaped frame and a fixed jaw disposed in the front end of the frame. A connecting end and an adjacent rectangular shaped recess are disposed at the rear end of the frame. A square hole is formed at the center of the holding seat. A fixed handle which has a groove to receive a driving handle connects the holding seat. A hole on the driving handle and two corresponding holes on the fixed handle are passed through by a pin so that the two handles are fastened together. A square hole is formed on the fixed handle. A square spindle is inserted through the square hole of the fixed handle and the square hole of the holding seat. A spring and a pushing plate which has a square hole receives the spindle so that the spring and the plate are blocked by the holding seat. The flange which is disposed on the upper end of the driving handle pushes the pushing plate forwardly.

1 Claim, 5 Drawing Sheets

C CLAMP

The present invention is a divisional application of application Ser. No. 8/501,424, filed Jul. 3, 1995 now abandoned.

BACKGROUND OF THE INVENTION

The invention relates to a screw clamp such as a C-clamp. More particulary, the invention relates to a C-clamp with a square or hexagonal spindle.

A conventional C-clamp has a threaded rod which is slowly forward to a predetermined position to clamp an article. However, the forward motion of the threaded rod is very slow. Another conventional C-clamp applies a round rod to replace the threaded rod. However, the round rod is easily slided or loosened while a machine is bumped or vibrated so that the article cannot be clamped tightly.

SUMMARY OF THE INVENTION

An object of the invention is to provide a C-clamp which can clamp an article tightly.

Another object of the invention is to provide a C-clamp which is easily assembled.

Accordingly, a C-clamp has a generally C-shaped frame and a fixed jaw disposed in the front end of the frame. A connecting end and an adjacent rectangular shaped recess are disposed at the rear end of the frame. A square hole is formed at the center of the holding seat. A fixed handle which has a groove to receive a driving handle connects the holding seat. A hole on the driving handle and two corresponding holes on the fixed handle are passed through by a pin so that the two handles are fastened together. A square hole is formed on the fixed handle. A square spindle is inserted through the square hole of the fixed handle and the square hole of the holding seat. A spring and a pushing plate which has a square hole receives the spindle so that the spring and the plate are blocked by the holding seat. The flange which is disposed on the upper end of the driving handle pushes the pushing plate forwardly.

DETAILED DESCRIPTION OF THE INVENTION

Figure 1:
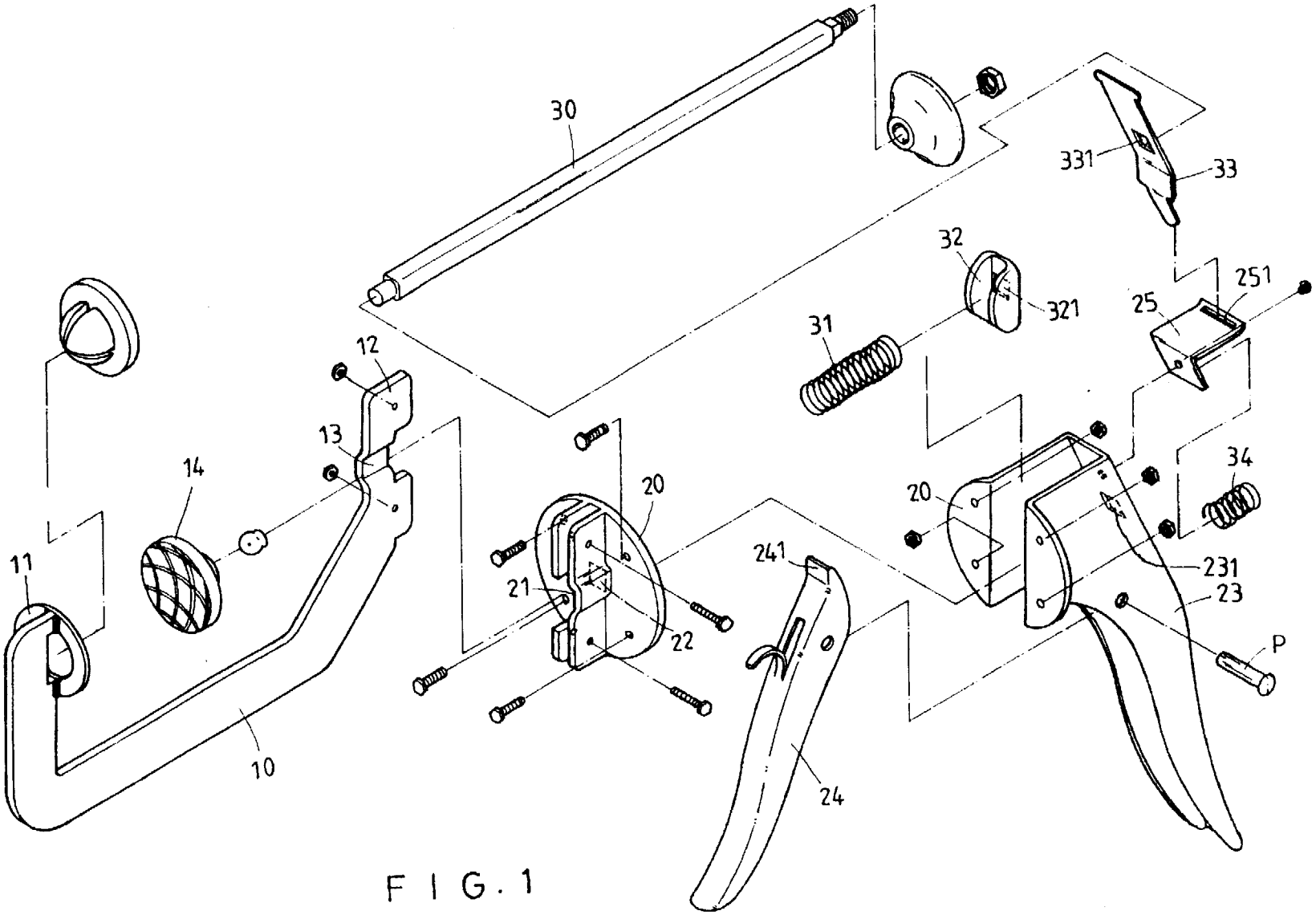
FIG. 1 is a perspective exploded view of a C-clamp of a preferred embodiment in accordance with the invention.
Figure 2:
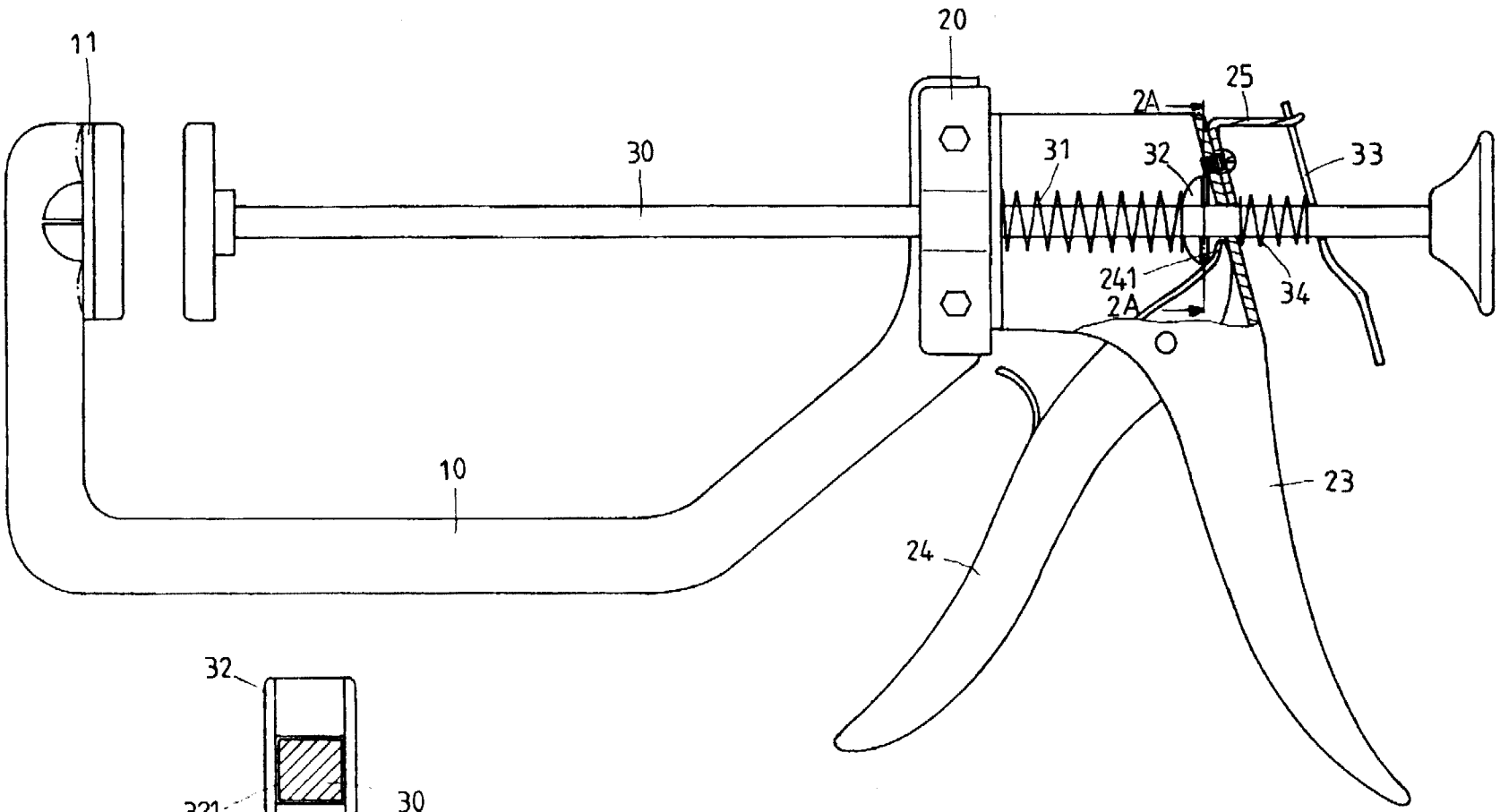
FIG. 2 is a perspective assembly view of FIG. 1.
Figure 2A:
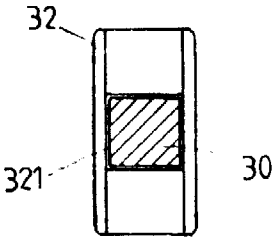
FIG. 2A is a sectional view taken along line 2A—2A of FIG. 2.

Referring to FIGS. 1, 2 and 2A, a C-clamp contains a generally C-shaped frame 10 and a fixed jaw 11 disposed in the front end of the frame 10. A connecting end 12 and an adjacent rectangular shaped recess 13 are disposed at the rear end of the frame 10. A rectangular shaped recess 21 which is formed on the lobe in front of the holding seat 20 matches the rectangular shaped recess 13 to form a square passage. A square hole 22 is formed at the center of the holding seat 20. A fixed handle 23 which has a groove to receive a driving handle 24 connects the holding seat 20. A hole on the handle 24 and two corresponding holes on the handle 23 are passed through by a pin P so that the two handles 23 and 24 are fastened together. A square hole 231 is formed on the handle 23. A square spindle 30 is inserted in the square hole 231, the square hole 22 and the square passage which is formed by the recesses 13 and 21. A spring 31 and a pushing plate 32 which has a square hole 321 receives the spindle 30 so that the spring 31 and the plate 32 are blocked by the holding seat 20. The flange 241 which is disposed on the upper end of the driving handle 24 pushes the pushing plate 32 forwardly. Thus the spindle 30 is moved forwardly. The spindle 30 and the plate 32 are not perpendicular to each other while the spindle 30 moves forwardly. A generally L-shaped plate 25 disposed on the upper back portion of the handle 23. A through hole 251 is formed on the end of the plate 25 in order to receive an upper end of the braking plate 33. A square hole 331 is formed on the plate 33 in order to receive the spindle 30. A spring 34 which receives the spindle 30 is blocked between the back of the handle 23 and the plate 33. When the spindle 30 moves forwardly, the plate 33 is skew so that the spindle 30 is blocked by the hole 331. Thus the spindle 30 cannot move rearwardly. When the driving handle 24 is released, the spindle 30 can passes the square hole 321 easily. The plate 33 will not block the motion of the spindle 30.

Figure 3:
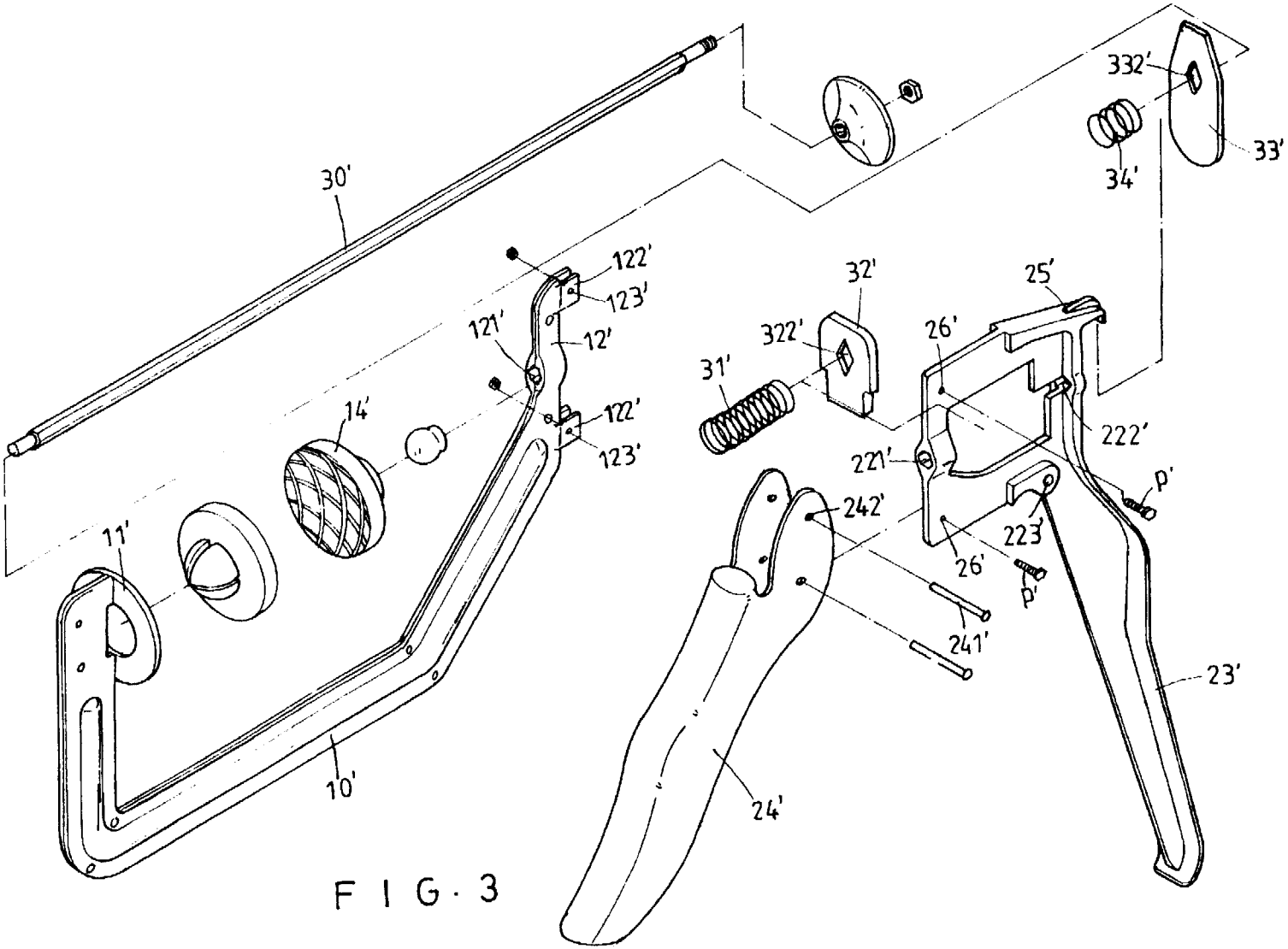
FIG. 3 is a perspective exploded view of a C-clamp of another preferred embodiment in accordance with the invention.
Figure 4:
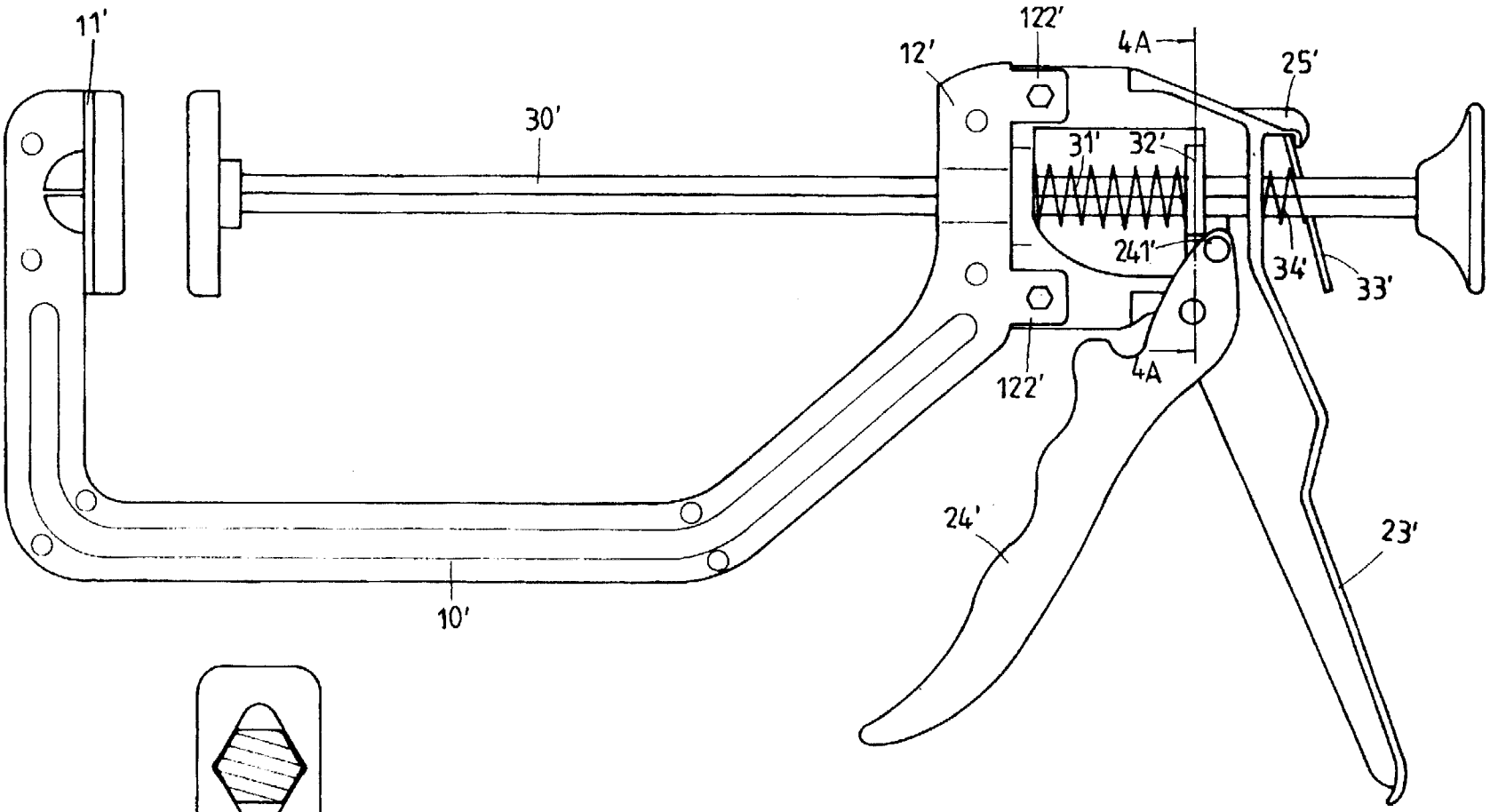
FIG. 4 is a perspective assembly view of FIG. 3.
Figure 4A:
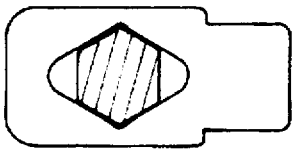
FIG. 4A is a sectional view taken along line 4B—4B in FIG. 4.

Referring to FIGS. 3, 4 and 4A, a second preferred embodiment is illustrated. A C-clamp contains a generally C-shaped frame 10' and a fixed jaw 11' disposed in the front end of the frame 10'. A connecting end 12' which has two fixed fins 122' disposed at its back is disposed at the rear end of the frame 10'. A hexangonal shaped recess 121' which is formed on the connecting end 12' receives the spindle 30'. Each fin 122' has a hole 123'. A driving handle 24' which has a groove to receive a fixed handle 23' has two holes to be inserted by two corresponding pins P'. The handle 23' has two holes 26' in front portion to match the holes 123' on the corresponding fins 122'. Two pins P' pass through the holes 26' on the handle 23 and the holes 123' on the fins 122' in order to fasten the C-shaped frame 10' and the fixed handle 23' together. The front portion of the handle 23' is inserted between the fins 122' and positioned by the fins 122'. The driving handle 24' has two holes 242' to match the corresponding holes 222' and 223' on the fixed handle 23'. Two pins 24' pass the corresponding holes 242' and 222' or 223' to fasten the two handles 23' and 24' together. The spindle 30' passes the hexagonal holes 121', 221' and 322'. The spring 31' and the pushing plate 32' are disposed in the handle 23'. The pushing plate 32' has a hexagonal hole 322'. The hexagonal hole 221' is formed at the front portion of the handle 23'. A lobe 25' is disposed on the upper rear portion of the handle 23'. A spring 34' and a braking plate 33' with a hexagonal hole 332' receives the rear portion of the spindle 30'. The upper portion of the braking plate 33' is hooked by the lobe 25'. The spring 34' is restricted between the braking plate 33' and the back of the handle 23'. The periphery of the hexagonal holes 221', 322' and 332' provide friction force and pushing force for the spindle 30'.

Figure 6:
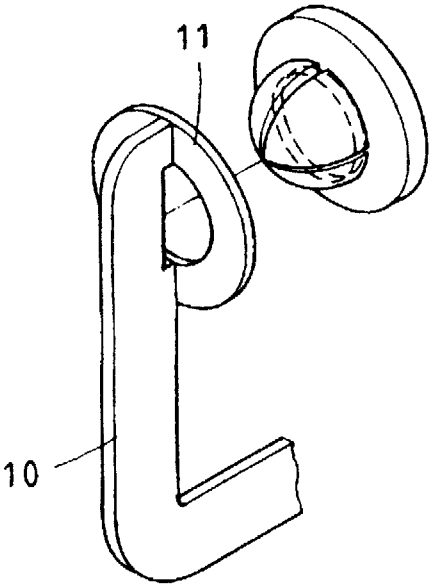
FIG. 6 illustrates a schematic view of spot welding of the fixed jaw in FIG. 1.
Figure 5:
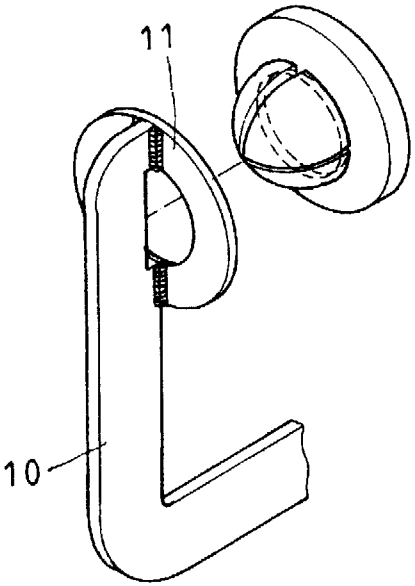
FIG. 5 illustrates a schematic view of CO welding of the fixed jaw in FIG. 1.
Figure 7:
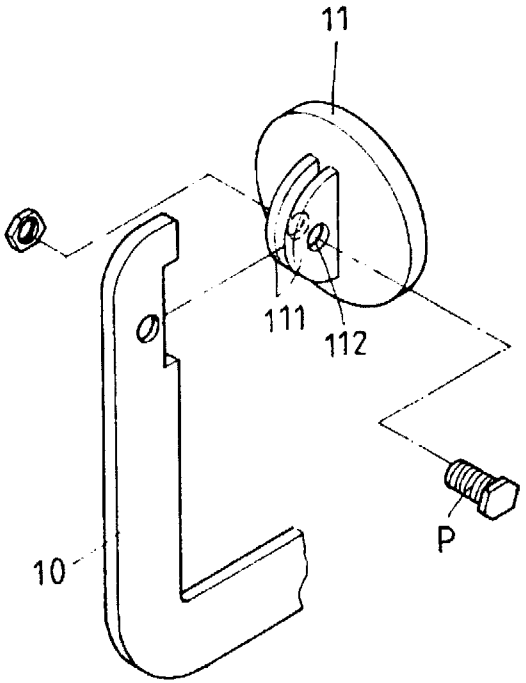
FIG. 7 is a perspective exploded view of the fixed jaw in FIG. 1.

FIG. 5 illustrates the CO welding between the fixed jaw 11 and the C-shaped frame 10. FIG. 6 illustrates the spot welding between the fixed jaw 11 and the C-shaped frame 10. FIG. 7 illustrates the combination of the jaw 11 and the C-shaped frame 10. A gap between two lobes 111 of the jaw 11 receives the C-shaped frame 10. Each lobe 111 has a lobe 112 to match the hole on the front portion of the C-shaped frame 10. A screw P fastens the lobes 111 and the C-shaped frame 10 together.

The invention is not limited to the above embodiment but various modification thereof may be made. It will be understood by those skilled in the art that various changes in form and detail may be made without departing from the spirit and scope of the invention.

What is claimed is:

1. A C-clamp comprising:

a generally C-shaped frame;

a fixed jaw disposed in front end of said frame;

a connecting end and an adjacent rectangular shaped recess disposed at a rear end of said frame;

a holding seat connecting a front portion of a fixed handle;

a square hole formed at a center of said holding seat;

a fixed handle which has a groove to receive a driving handle connecting said holding seat;

a driving handle being fastened to said fixed handle;

a square spindle being inserted through a square hole of said fixed handle and said square hole of said holding seat;

a spring and a pushing plate which has a square hole receiving said spindle so that said spring and said pushing plate are blocked by said holding seat;

a flange which is disposed on the upper end of said driving handle pushing said pushing plate forwardly;

a generally L-shaped plate disposed on the upper back portion of said fixed handle;

a through hole formed on the end of said L-shaped plate to receive an upper end of a braking plate;

said braking plate having an upper portion to be blocked by said L-shaped plate;

a square hole formed on said braking plate to receive said spindle;

a second spring which receives said spindle is blocked between a back portion of said fixed handle and said braking plate.

* * * * *